US010856644B2

(12) United States Patent
Yoon

(10) Patent No.: US 10,856,644 B2
(45) Date of Patent: Dec. 8, 2020

(54) WASHING BRUSH CAPABLE OF WASHING VARIOUSLY SIZED CONTAINERS

(71) Applicant: Seung-Eun Yoon, Daejeon (KR)

(72) Inventor: Kang-Hyun Yoon, Daejeon (KR)

(73) Assignee: Seung-Eun Yoon, Daejeon (KR)

( * ) Notice: Subject to any disclaimer, the term of this patent is extended or adjusted under 35 U.S.C. 154(b) by 0 days.

(21) Appl. No.: 16/646,997

(22) PCT Filed: Sep. 13, 2018

(86) PCT No.: PCT/KR2018/010779
§ 371 (c)(1),
(2) Date: Mar. 12, 2020

(87) PCT Pub. No.: WO2019/059583
PCT Pub. Date: Mar. 28, 2019

(65) Prior Publication Data

US 2020/0214434 A1 Jul. 9, 2020

(30) Foreign Application Priority Data

Sep. 22, 2017 (KR) ..... 10-2017-0122196

(51) Int. Cl.
*A46B 5/00* (2006.01)
*A46B 7/02* (2006.01)
(Continued)

(52) U.S. Cl.
CPC ..... *A46B 5/0025* (2013.01); *A46B 5/005* (2013.01); *A46B 5/0037* (2013.01); *A46B 5/02* (2013.01);
(Continued)

(58) Field of Classification Search
CPC ..... A46B 5/0025; A46B 5/005; A46B 7/02; A46B 2200/3006
See application file for complete search history.

(56) References Cited

U.S. PATENT DOCUMENTS 3,750,214 A * 8/1973 Caliendo ..... A46B 7/02 15/26
2003/0056809 A1* 3/2003 Horton ..... A47L 17/04 134/8
(Continued)

FOREIGN PATENT DOCUMENTS

KR 20-2000-0019390 U 11/2000
KR 10-2002-0046129 A 6/2002
(Continued)

*Primary Examiner* — Randall E Chin
(74) *Attorney, Agent, or Firm* — Im IP Law; Chai Im; C. Andrew Im

(57) ABSTRACT

A washing brush to wash a container having a long length. The washing brush includes a handle part, a shaft part connected to the handle part, a sliding part configured to slide along the shaft part, a strip part coupled to the lower end part of the shaft part and lower part of the sliding part, a brush part attached to the outside of the strip part; and a position adjusting part configured to adjust a relative position of the shaft part. The sliding part is pressed to spread the strip part and the spread can be varied by the position adjusting part by adjusting the relative position of the sliding part with respect to the shaft part. A washing brush is provided that can simply and quickly wash a cylindrical container by allowing a washing part to be spread according to the shape of a container.

6 Claims, 9 Drawing Sheets

(51) Int. Cl.
*A46B 5/02* (2006.01)
*A46B 9/02* (2006.01)

(52) U.S. Cl.
CPC ..... *A46B 7/02* (2013.01); *A46B 9/026* (2013.01); *A46B 2200/3006* (2013.01)

(56) References Cited

U.S. PATENT DOCUMENTS

2004/0187241 A1* 9/2004 Katz ..... A46B 5/0079
15/144.4
2006/0185104 A1* 8/2006 Le ..... A46B 13/02
15/22.1

FOREIGN PATENT DOCUMENTS

KR 10-2010-0040173 A 4/2010
KR 20-2010-0006157 U 6/2010
KR 10-2011-0017074 A 2/2011

* cited by examiner

WASHING BRUSH CAPABLE OF WASHING VARIOUSLY SIZED CONTAINERS

RELATED APPLICATIONS

This application is a § 371 application of PCT/KR2018/010779 filed Sep. 13, 2018, which claims priority from Korean Patent Application No. 10-2017-0122196 filed Sep. 22, 2017, each of which is incorporated herein by reference in its entirety.

TECHNICAL FIELD

The present invention relates to a washing brush capable of washing long containers.

BACKGROUND OF THE INVENTION

In general, people wash non-deep cups or containers by hands using a sponge or a pad, but wash deep or long cups or containers using a washing brush having a handle due to a limitation in depth that the user can put the hand into the cups or containers.

A conventional washing brush which is in the form of a straight bar is narrow and long so as to be capable of washing cups or containers with a wide mouth, but is difficult to wash containers with a narrow mouth every nook and corner since the brush is not bent. Moreover, such a conventional washing brush has a disadvantage in that it takes much time to wash the containers or cups and it is inconvenient to wash the containers or cups since the user has to wash them while bringing the washing brush closer to the wall surface of the cups or containers and moving the hand as making a circular motion in spite of the cups or containers with a wide mouth.

Therefore, people demand a washing brush capable of washing cylindrical containers of various shapes conveniently and rapidly.

PATENT LITERATURE

Patent Document 1: Korean Utility Model Application No. 20-2015-0004491

OBJECT AND SUMMARY OF THE INVENTION

Technical Problem

Accordingly, the present invention has been made in an effort to solve the above-mentioned problems occurring in the prior arts that cannot wash containers with a narrow mouth every nook and corner since the brush is not inserted into the containers or is not bent, and it is an object of the present invention to provide a washing brush which includes a washing part capable of spreading according to shapes of containers in order to wash cylindrical containers conveniently and rapidly.

Technical Solution

To achieve the above objects, the present invention provides a washing brush capable of washing containers of various sizes, the washing brush including: a handle part capable of being held by a user's hand; a shaft part connected to the handle part to extend in a longitudinal direction; a sliding part capable of sliding along the shaft part by being fit over a part of the shaft part; a strip part joined to a lower end portion of the shaft part and a lower portion of the sliding part; a brush part attached to the outside of the strip part; and a position adjusting part capable of adjusting a relative position for the shaft part while enabling the sliding part to slide along the shaft part, wherein the sliding part is pressed toward the lower end portion of the shaft part so as to bend the strip part such that the strip part spreads outwards, and the position adjusting part adjusts the relative position of the sliding part relative to the shaft part so as to adjust the level that the strip part spreads outwards.

Moreover, the strip part gets thicker upwards from the lower end portion of the shaft part.

Furthermore, the strip part includes a groove of a predetermined depth formed to be adjacent to a joining part joined to the lower portion of the sliding part.

Additionally, the strip part includes a plurality of grooves spaced apart from each other at predetermined intervals.

Moreover, the strip part includes a plurality of grooves formed in the surface facing the shaft part to be spaced apart from each other at predetermined intervals, and the grooves get shallower upwards from the lower end portion of the shaft part.

Furthermore, the position adjusting part includes a plurality of grooves formed in the shaft part to be spaced apart from each other at predetermined intervals, and protrusions formed on the lower end portion of the sliding part to be fit to the grooves, and the relative position of the sliding part relative to the shaft part is adjusted by the way that the protrusions are fit into the grooves.

Advantageous Effects

The washing brush according to the present invention includes the washing part capable of spreading according to shapes of containers, thereby washing cylindrical containers conveniently and rapidly.

DETAILED DESCRIPTION OF THE EMBODIMENTS

Figure 1:
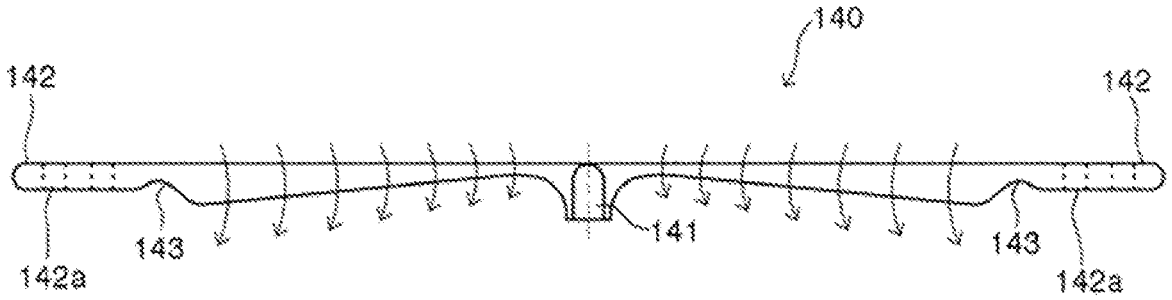
FIG. 1 is a view showing a strip part of a washing brush according to a first embodiment of the present invention.

Hereinafter, exemplary embodiments of the present invention will be described in detail with reference to accompanying drawings. In assigning reference numerals to elements in each drawing, it shall be noted that like elements have like reference numerals as much as possible even if illustrated in different drawings.

Figure 2A:
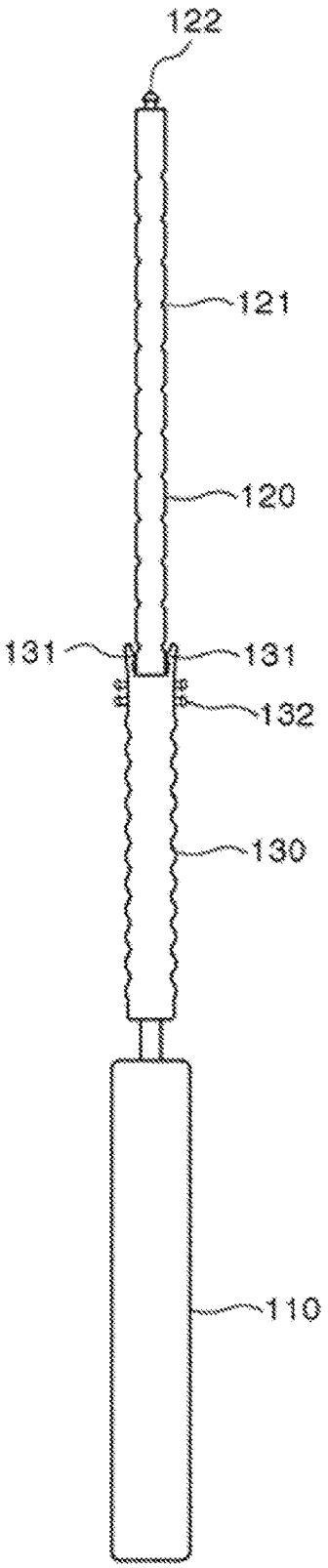
FIGS. 2A and 2B are views showing a shaft part and a sliding part of the washing brush according to the first embodiment of the present invention.
Figure 2B:
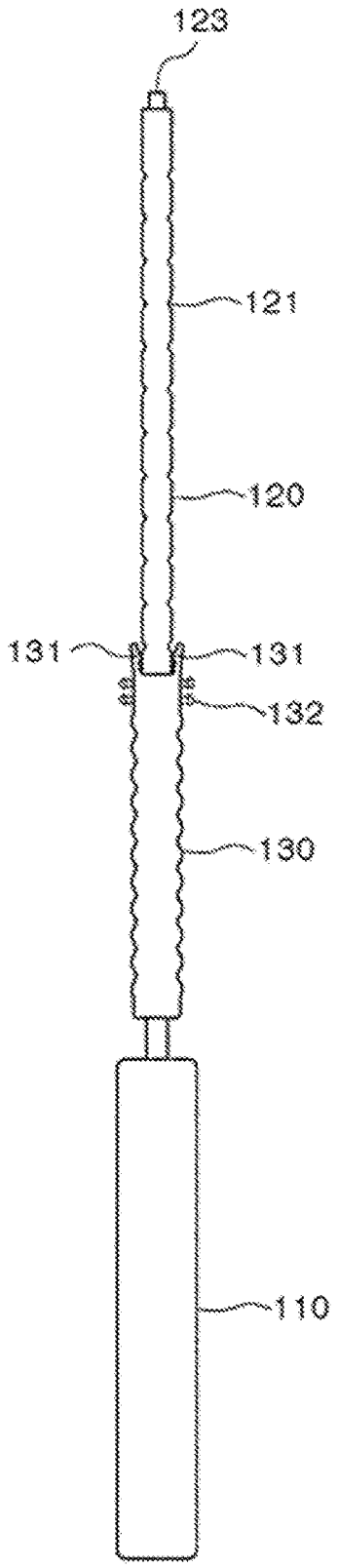
Figure 3:
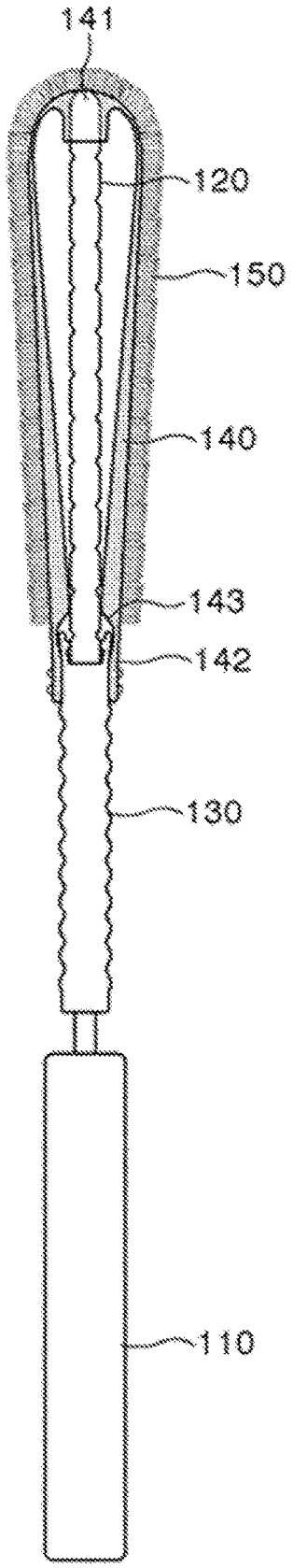
FIG. 3 is a view showing the washing brush according to the first embodiment of the present invention.
Figure 4:
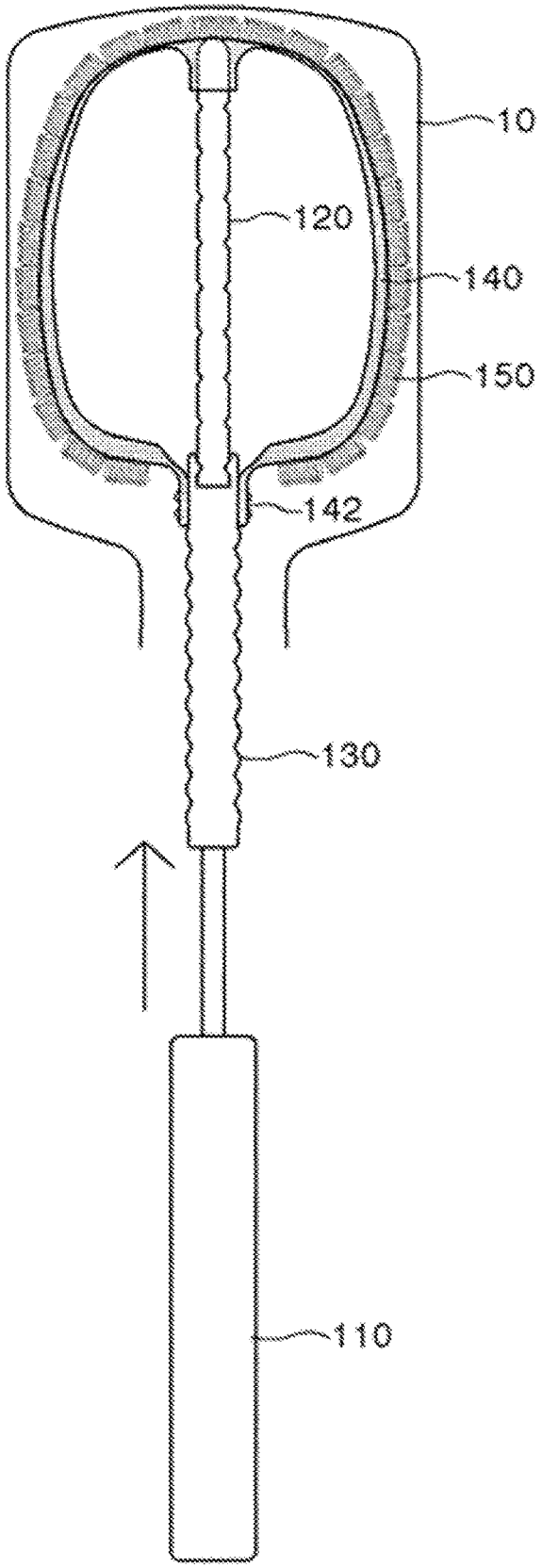
FIG. 4 is a view showing a state where the strip part of FIG. 3 is bent.

FIG. 1 is a view showing a strip part of a washing brush according to a first embodiment of the present invention, FIGS. 2A and 2B are views showing a shaft part and a sliding part of the washing brush according to the first embodiment of the present invention, FIG. 3 is a view showing the washing brush according to the first embodiment of the present invention, and FIG. 4 is a view showing a state where the strip part of FIG. 3 is bent.

Referring to FIGS. 1 to 3, the washing brush according to the first embodiment of the present invention includes a handle part 110, a shaft part 120, a sliding part 130, a strip part 140, and a brush part 150.

The handle part 110 is configured such that a user can hold it with the hand.

The shaft part 120 is connected to the handle part 110 to extend in a longitudinal direction. Joining parts 122 and 123 are formed at a lower end portion of the shaft part 120 to be joined with the strip part 140. In a state where the joining parts 122 and 123 are joined with the strip part 140, when the user rotates the handle part 110 to wash a container 10, the shaft part 120 and the strip part 140 can be rotated together. For this, the joining parts 122 and 123 have an oval or polygonal cross section.

The sliding part 130 is fit over a part of the shaft part 120 to be able to slide along the shaft part 120.

The strip part 140 is joined to the lower end portion of the shaft part 120 and a lower portion of the sliding part 130. The strip part 140 may have a long band shape, and has joining parts 141 and 142 disposed at the center and both end portions thereof. The joining part 141 is joined with the lower end portion of the shaft part 120, and the joining part 142 is joined with the sliding part 130. For instance, the joining part 142 has an opening 142*a* and the sliding part 130 has a protrusion pin 132, so that the joining part 142 and the sliding part 130 are combined with each other when the opening 142*a* is fit over the protrusion pin 132. The way that the strip part 140 is combined with the shaft part 120 and the sliding part 140 may be achieved by various methods known in the technical field. The strip part 140 may have predetermined rigidity and elasticity.

The strip part 140 has a cross-sectional shape getting thicker upwards from the lower end portion of the shaft part 120. In FIG. 1, lengths of arrows express intensity of power to bend the strip part 140. That is, while the strip part 140 gets thicker upwards from the lower end portion of the shaft part 120, a portion adjoining the lower end portion of the shaft part 120 is bent when small power is applied, and a portion adjoining an upper portion of the shaft part 120 is bent when stronger power is applied.

Furthermore, the strip part 140 has a groove 143 with a predetermined depth adjacent to the joining part 142 combined with the lower portion of the sliding part 130. Such a groove 143 is to make the portion adjoining the combining part 142 bent toward a direction that the strip part 140 spreads, and may be formed on the side facing the shaft part 120 or on the opposite side of the shaft part 120.

The brush part 150 is attached to the outer surface of the strip part 140 so as to wash the container 10. The brush part 150 may be an individual member separated from the strip part 140 and may be attached to the strip part 140 by adhesive or other adhering means. On the other hand, the brush part 150 may be formed integrally with the strip part 140 to protrude from the strip part 140.

A position adjusting part can adjust a relative position of the sliding part 130 relative to the shaft part 120 while sliding the sliding part 130 along the shaft part 120.

The position adjusting part includes: a plurality of grooves 121 formed in the shaft part 120 to be spaced apart from each other at predetermined intervals; and protrusions 131 formed at both sides of the lower end portion of the sliding part 130 to be fit to the grooves 121. When the user pushes the sliding part 130 toward the lower end portion of the shaft part 120, the protrusions 131 are fit to the grooves 121 to adjust the relative position of the sliding part 130 relative to the shaft part 120.

The position adjusting part may be configured such that the protrusions are formed on the shaft part 120 and the plurality of openings are formed in the sliding part 130 to be spaced apart from each other. While the sliding part 130 slides along the shaft part 120, the protrusions protrude over the openings so as to limit movement of the sliding part 130 relative to the shaft part 120.

Additionally, when the strip part 140 is joined to the sliding part 130 by a fastening member and the fastening member protrudes toward the shaft part 120 at a predetermined distance, the position adjusting part may provide the shaft part 120 with proper friction force. Therefore, the fastening member can adjust the relative position for the shaft 120 by providing the proper friction force while enabling the sliding part 130 to slide along the shaft part 120.

It will be understood by those of ordinary skill in the art that the position adjusting part may be realized by other various ways.

When the position adjusting part adjusts the relative position of the sliding part 130 relative to the shaft part 120, the sliding part 130 is pressed toward the lower end portion of the shaft part 120 so that the strip part 140 is bent to spread outwardly. In addition, the position adjusting part can adjust the level that the strip part 140 spreads outwardly by adjusting the relative position of the sliding part 130 relative to the shaft part 120.

Referring to FIG. 4, the strip part 140 is bent outwardly to be suitable for the shape of the inner surface of the cylindrical container 10 with a narrow mouth so that the user can easily wash the container. The conventional washing brush is inconvenient to wash cylindrical containers with a narrow mouth since the shape of the brush is not variable. However, because the strip part 140 has the cross-sectional shape getting thicker upwards from the lower end portion of the shaft part 120, the strip part 140 spreads wider when the user holds the washing brush and applies greater power toward the bottom surface of the container 10. Therefore, the strip part 140 of the washing brush gets closer to the inner surface of the container 10 to wash the container 10 by the brush part 150 regardless sizes of the container 10.

Figure 5:
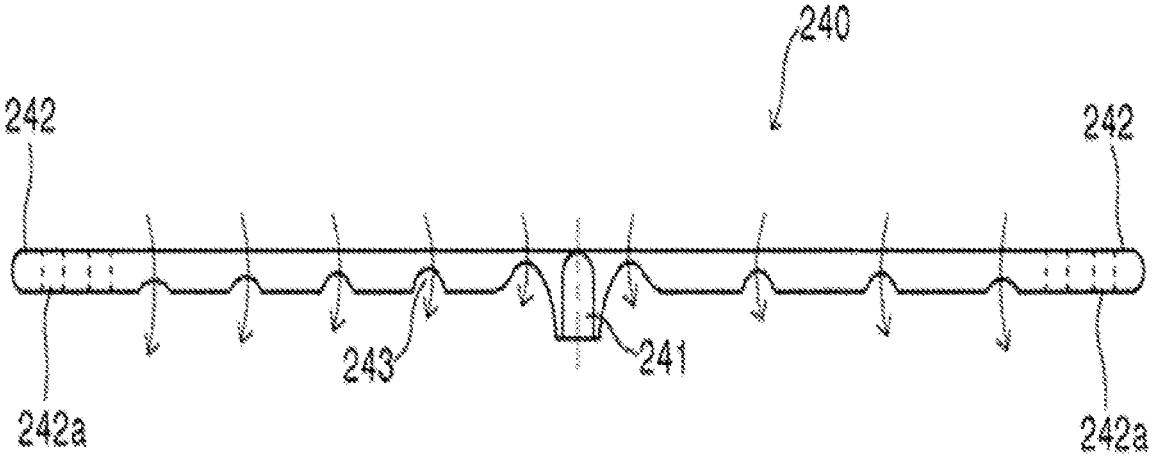
FIG. 5 is a view showing a strip part of a washing brush according to a second embodiment of the present invention.
Figure 6:
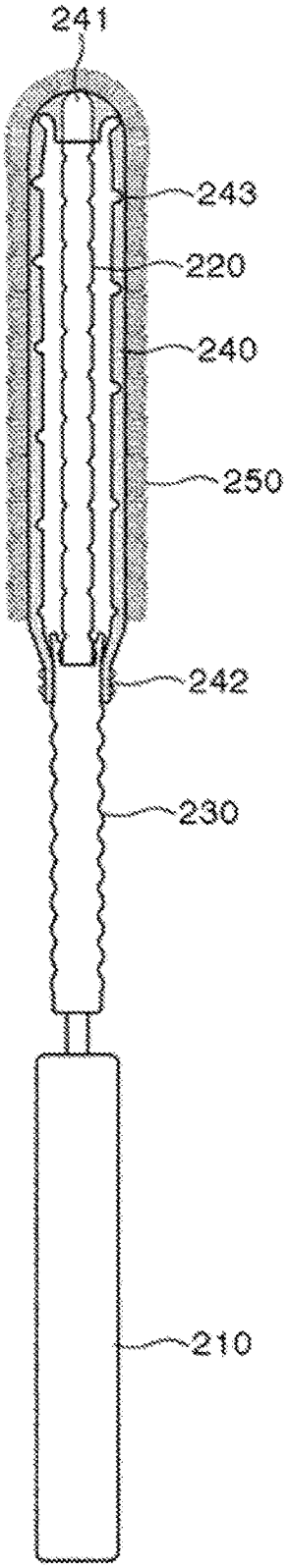
FIG. 6 is a view showing the washing brush according to the second embodiment of the present invention.
Figure 7:
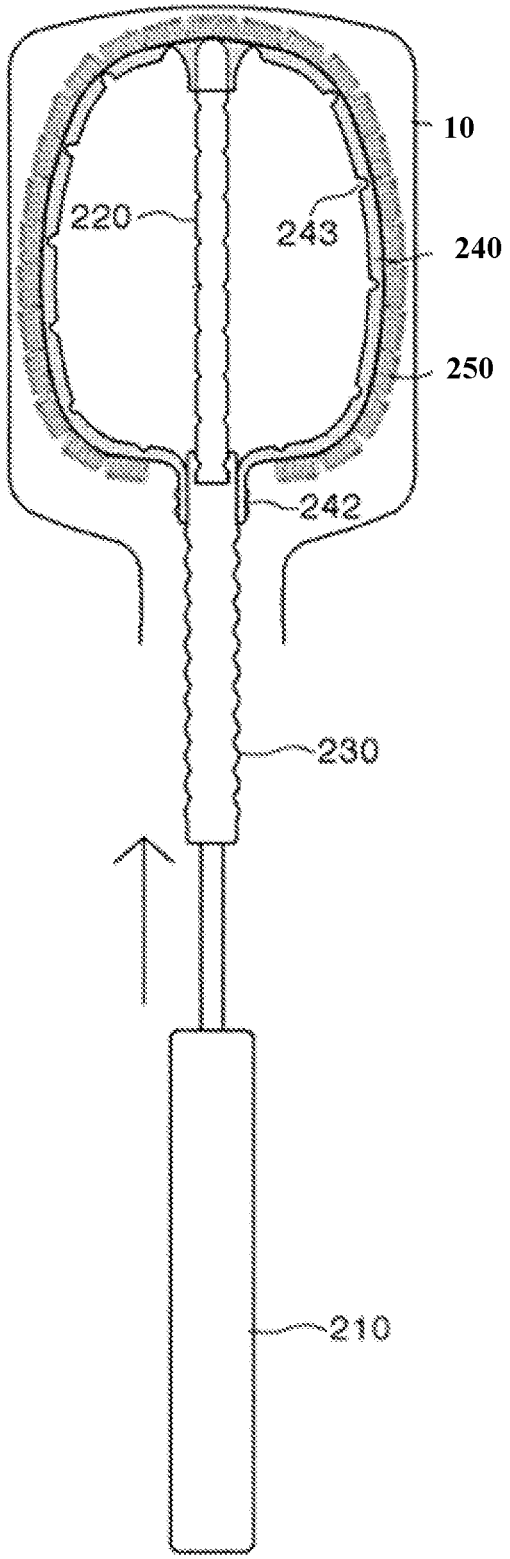
FIG. 7 is a view showing a state where the strip part of FIG. 6 is bent.

FIG. 5 is a view showing a strip part of a washing brush according to a second embodiment of the present invention, FIG. 6 is a view showing the washing brush according to the second embodiment of the present invention, and FIG. 7 is a view showing a state where the strip part of FIG. 6 is bent.

In the second embodiment of the present invention, the washing brush includes a handle part 210, a shaft part 220, a sliding part 230, a strip part 240, and a brush part 250. A detailed description of the handle part 210, the shaft part 220, the sliding part 230 and the brush part 250 will be omitted since they have the same structures as the handle part 110, the shaft part 120, the sliding part 130 and the brush part 150 of the washing brush according to the first embodiment illustrated in FIG. 3.

The strip part 240 is joined with a lower end portion of the shaft part 220 and a lower portion of the sliding part 230. The strip part 240 may have a long band shape, and has joining parts 241 and 242 disposed at the center and both end portions thereof. The joining part 241 is joined with the lower end portion of the shaft part 220, and the joining part 242 is joined with the sliding part 230. For instance, the joining part 242 has an opening 242*a* and the sliding part 230 has a protrusion pin 232, so that the joining part 242 and the sliding part 230 are combined with each other when the opening 242*a* is fit over the protrusion pin 232. The way that the strip part 240 is combined with the shaft part 220 and the sliding part 240 may be achieved by various methods known in the technical field. The strip part 240 may have predetermined rigidity and elasticity.

The strip part 240 includes a plurality of grooves 243 formed in the surface facing the shaft part 220 to be spaced apart from each other at a predetermined interval, and the grooves 243 get shallower upwards from the lower end portion of the shaft part 220. In FIG. 5, lengths of arrows express intensity of power to bend the strip part 240. That is, while the strip part 240 gets shallower upwards from the lower end portion of the shaft part 220, a portion adjoining the lower end portion of the shaft part 220 is bent when small power is applied, and a portion adjoining an upper portion of the shaft part 220 is bent when stronger power is applied.

Moreover, because the grooves 243 are formed to the portion adjoining the joining part 242 joined to the lower portion of the sliding part 230, the portion adjoining the joining part 242 may be also bent when a predetermined force is applied.

A position adjusting part can adjust a relative position of the sliding part 230 relative to the shaft part 220 while sliding the sliding part 230 along the shaft part 220.

Referring to FIG. 7, the strip part 240 is bent outwardly to be suitable for the shape of the inner surface of the cylindrical container 20 with a narrow mouth so that the user can easily wash the container. In this instance, because the grooves 243 formed in the strip part 240 get shallower upwards from the lower end portion of the shaft part 220, the strip part 240 spreads wider when the user holds the washing brush and applies greater power toward the bottom surface of the container 10. Therefore, the strip part 240 of the washing brush gets closer to the inner surface of the container 10 to wash the container 10 by the brush part 150 regardless sizes of the container 10.

Figure 8:
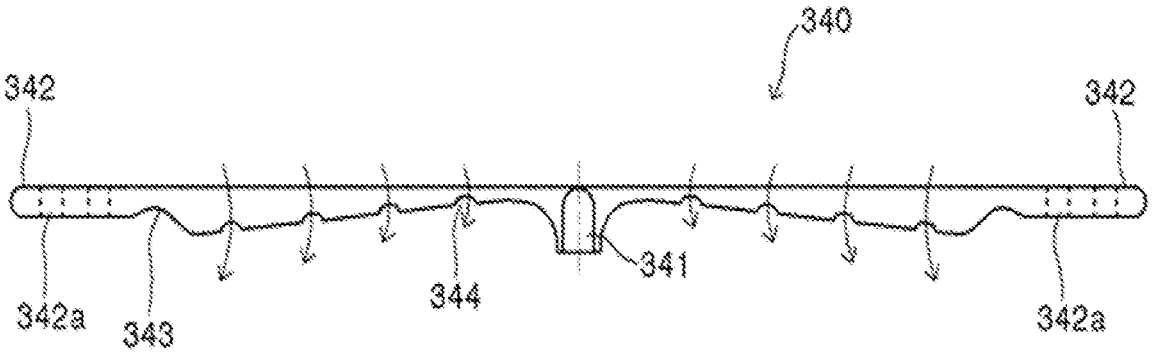
FIG. 8 is a view showing a strip part of a washing brush according to a third embodiment of the present invention.

FIG. 8 is a view showing a strip part of a washing brush according to a third embodiment of the present invention.

Referring to FIGS. 2A and 8, a strip part 340 is joined to a lower end portion of the shaft part 120 and a lower portion of the sliding part 130. The strip part 340 may have a long band shape, and has joining parts 341 and 342 disposed at the center and both end portions thereof. The joining part 341 is joined with the lower end portion of the shaft part 120, and the joining part 342 is joined with the sliding part 130. For instance, the joining part 342 has an opening 342*a* and the sliding part 130 has the protrusion pin 132, so that the joining part 342 and the sliding part 330 are combined with each other when the opening 342*a* is fit over the protrusion pin 132.

The strip part 340 has a cross-sectional shape getting thicker upwards from the lower end portion of the shaft part 120. In FIG. 8, lengths of arrows express intensity of power to bend the strip part 340. That is, while the strip part 340 gets thicker upwards from the lower end portion of the shaft part 120, a portion adjoining the lower end portion of the shaft part 120 is bent when small power is applied, and a portion adjoining an upper portion of the shaft part 120 is bent when stronger power is applied.

Furthermore, the strip part 340 has a groove 343 with a predetermined depth formed in the surface which is adjacent to the joining part 342 combined with the lower portion of the sliding part 130 and faces the shaft part 120. Such a groove 343 is to make the portion adjoining the combining part 342 bent toward a direction that the strip part 340 spreads, and may be formed on the side facing the shaft part 120 or on the opposite side of the shaft part 120.

Furthermore, the strip part 340 may have grooves 344 spaced apart from each other at predetermined intervals. Such grooves 344 have the same depth, and make the strip part 340 bent well in order from the lower end portion of the shaft part 120.

While the exemplary embodiments of the present invention have been described in more detail with reference to the accompanying drawings, but the present invention is not essentially limited to the exemplary embodiments, and it will be understood by those of ordinary skill in the art that various modifications and equivalents may be made without deviating from the spirit or scope of the invention.

EXPLANATION OF ESSENTIAL REFERENCE NUMERALS IN DRAWINGS

10: Container
110: Handle part
120: Shaft part
121: Groove
122, 123: Joining part
130: Sliding part
131: Protrusion
132: Protrusion pin
140: Strip part
141, 142: Joining part
142*a*: Opening
150: Brush part

The invention claimed is:

1. A washing brush comprising:
a handle part configured to be held by a user's hand;
a shaft part connected to the handle part and extending in a longitudinal direction;
a sliding part configured to slide along the shaft part by fitting over a portion of the shaft part;
a strip part joined to a lower end portion of the shaft part and a lower portion of the sliding part, the lower end portion of the shaft part and the lower portion of the sliding part being distal from the handle part;
a brush part attached to an outer portion of the strip part;
a position adjusting part configured to adjust a relative position of the sliding part relative to the shaft part while enabling the sliding part to slide along the shaft part;
wherein the sliding part is pressable toward the lower end portion of the shaft part to bend and spread outwardly the strip part; and
wherein the spread of the strip part is adjustable by the position adjusting part by varying the relative position of the sliding part relative to the shaft part.

2. The washing brush according to claim 1, wherein a thickness of the strip part increases from the lower end portion of the shaft part.

3. The washing brush according to claim 2, wherein the strip part comprises a groove of a predetermined depth formed adjacent to a joining part, the joining part connecting the strip part to the lower portion of the sliding part.

4. The washing brush according to claim 2, wherein the strip part comprises a plurality of grooves spaced apart from each other at predetermined intervals.

5. The washing brush according to claim 1, wherein the strip part comprises a plurality of grooves formed on a surface facing the shaft part, said plurality of grooves spaced apart from each other at predetermined intervals, and wherein depths of said plurality of grooves decreases from the lower end portion of the shaft part.

6. The washing brush according to claim 1, wherein the shaft part comprises a plurality of grooves formed spaced apart from each other at predetermined intervals; wherein the lower end portion of the sliding part comprises protrusions insertable into said plurality of grooves; and wherein the position adjusting part varies the relative position of the sliding part relative to the shaft part by repositioning the protrusions into different grooves.

* * * * *